US006200107B1

(12) United States Patent
Brewster

(10) Patent No.: US 6,200,107 B1
(45) Date of Patent: Mar. 13, 2001

(54) VACUUM PUMPING SYSTEMS

(75) Inventor: Barrie Dudley Brewster, Brighton (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/132,889

(22) Filed: Aug. 12, 1998

(30) Foreign Application Priority Data

Aug. 15, 1997 (GB) ..... 9717400

(51) Int. Cl.[7] ..... F04B 3/00

(52) U.S. Cl. ..... 417/251; 417/307; 417/520

(58) Field of Search ..... 417/251, 520, 417/307

(56) References Cited

U.S. PATENT DOCUMENTS

| | | | | |
|---|---|---|---|---|
| 4,850,806 | * | 7/1989 | Morgan et al. | 417/53 |
| 4,919,599 | | 4/1990 | Reich et al. . | |
| 5,040,949 | | 8/1991 | Crinquette et al. . | |
| 5,585,548 | * | 12/1996 | Grosse Bley et al. | 73/40.7 |

* cited by examiner

*Primary Examiner*—Timothy S. Thorpe
*Assistant Examiner*—Timothy P. Solak
(74) *Attorney, Agent, or Firm*—Salvatore P. Pace

(57) ABSTRACT

A vacuum pumping system for use with a process chamber. The pumping system has a first vacuum pump whose inlet is adapted for communication via a first line with a chamber outlet and a second vacuum pump whose inlet is adapted for communication via a second line with a first pump outlet. A third line containing a throttle valve is linked to the first and to the second lines in parallel to the first vacuum pump to enable variable amounts of gas to flow through the throttle valve from the second line to the first line depending on the position of the throttle valve.

7 Claims, 2 Drawing Sheets

VACUUM PUMPING SYSTEMS

BACKGROUND OF THE INVENTION

This invention relates to vacuum pumping systems and, more particularly, to such systems for use in controlling the pressure in a semiconductor processing chamber.

The requirements for a vacuum pumping system for use in the semiconductor industry are many and varied. In addition to evacuating the semiconductor processing chamber down to the required level of vacuum and exhausting the reaction gases used in the chamber in the manufacture of semiconductor devices from the chamber to atmosphere or to one many types of collection or scrubbing means, the pumping system is increasingly being used to control the pressures associated with the processing chamber by varying the rate at which the reaction gases are exhausted from the chamber.

In particular, there is a need in the semiconductor industry to provide a control on the pressure in the processing chamber independently of the process reaction gas flow quantity in, and from, the chamber. In addition, there may also be a need to provide a control on the reaction or other gas species present in the processing chamber in order to vary partial pressures of the reactive gases and reactive gas by-products, for example to exhaust the reactive by-products from the chamber at a rate faster than that of the reactive gases themselves or to promote means to reduce the time between cleaning operations in a chamber and the normal processing operations.

In a typical simple vacuum pumping system for use in the semiconductor industry, the processing chamber is connected to a system comprising a first vacuum pump (or pumps)—commonly a turbo-molecular pump—which is backed by a forepump (or pumps) connected to the first pump by a foreline and which can exhaust the gases from the semiconductor chamber to atmosphere.

In such a simple system, in an attempt to provide a means to exercise control on the pressure in the processing chamber to which it is attached, it has previously been prepared to provide a variable throttle valve either between the process chamber and the first pump(s) or in the foreline between the first pump(s) and the fore pump(s).

However, it has been found that the presence of a throttle valve can cause certain disadvantages. For example, if the throttle valve is at the inlet to the first pump, there is necessarily a restriction in to that pump even when the throttle valve is fully open, so that a larger and therefore more costly first pump (or pumps) is required.

If the throttle valve is in the foreline, the effect of it on the pumping rate of the first pump is to render it highly non-linear so that it becomes effective only over a narrow range of pressure. As such, the system as a whole is difficult to regulate in a stable manner if the process gas flow rate varies by a large amount.

In such a simple pumping system, it has also been proposed to introduce a variable flow of a ballast gas (or a spoiling gas) in to the foreline. However, this has generally not proved effective in allowing a control of the pressure in the processing chamber. In addition, the introduction of a ballast gas of a different composition to that used in the semiconductor processing may contaminate or dilute the process gases. If it is of the same composition, the flow rate may be large and therefore costly.

Furthermore, for the same general reasons, it has also been proposed to provide means to regulate the rotational speed of the first pump(s) or the forepump(s) or both. However, regulation of the rotational speed of the first pump, for example a turbo-molecular pump, cannot normally be achieved rapidly without requiring a large amount of extra power, due to the large moment of inertia of the pump rotor. This leads to the need for more expensive motor and drive electronics. Alternatively, the time required to regulate pressure in the processing chamber is long which in itself reduces the effectiveness of the pumping system as a whole.

Regulation of the rotational speed of the forepump suffers from the same disadvantages and, additionally, can make the pumping rate of the first pump non-linear and effective only over a narrow region of pressure.

Attempts to provide means to regulate the rotational speed of both the first pump and the forepump result in further expense and complexity and, in any event, do not fully overcome the disadvantages.

There is therefore a need for alternative means in such pumping systems for controlling the pressure as necessary in the processing chamber.

SUMMARY OF THE INVENTION

In accordance with the invention, there is provided a vacuum pumping system for use with a process chamber, comprising a first vacuum pump whose inlet is adapted for communication via a first line with a chamber outlet and a further vacuum pump whose inlet is adapted for communication via a second line with a first pump outlet, wherein a third line containing a throttle valve is linked to the first and to the second lines in parallel to the first vacuum pump to enable variable amounts of gas to flow through the valve from the second line to the first line depending on the position of the valve member.

The system of the invention therefore includes a recirculating loop for exhaust gases that have passed through the first pump back to the inlet of the first pump in amounts (including zero) dependent on the degree of opening of the throttle valve.

When the throttle valve is at least partially open, the gas will flow from the second line to the first line by means of the pressure differential across the first pump.

It has been found that the restriction caused by the throttle valve is greater for the reactive gases (typically having lighter molecular mass) than for the reaction by-product gases (typically having heavier molecular mass). This causes the pumping system to remove reactive gases from the chamber more quickly than the reaction by-product gases.

As such in the invention, because the restriction presented by the recirculation loop is greater for reactive gases than for reaction by-product gases, the loop modifies the pumping characteristic of the system so as to improve the pumping of by-products in relation to reactive gases.

The conductance of the throttle valve can be regarded as being inversely proportional to the square of the molecular mass of the gas passing through. This has been found to be a key reason why a throttle valve positioned at the inlet to the pump (as described above) causes light gases to be pumped more quickly than heavy ones and therefore why it is advantageous to eliminate the inlet throttle.

Similarly, it has been found that the throttle loop recirculates light gases more readily than heavy ones and therefore the addition of the throttle loop can suppress the pumping of lighter gases.

Additionally, the reactant gases are generally lighter than the reaction by-products and therefore it has been found that the combined effect of removing the inlet throttle and adding the throttle loop causes the by-products to be pumped preferentially in relation to the reactant gases.

The first pump preferably comprises a turbo-molecular pump having a stator and a rotor with both having a number of arrays of angled blades to effect a pumping action in a manner known per se. The first pump may have additional stages of the same or different type or may comprise two or more separate pumps collectively referred to as the "first pump".

In preferred embodiments, the first pump comprises a turbo-molecular pump and one or more molecular drag or regenerative stages contained in the same pump body.

In certain embodiments, when the first vacuum pump comprises one or more stages in the same pump or two or more separate pumps, the third line containing the throttle valve should link the first line at the first inlet to the first pump but may be linked at its other end to the outlet of any of the first pump stages.

The second pump may comprise any type of vacuum pump normally used for backing a turbo molecular pump and cable of delivering the gases exhausted from the system to atmospheric pressure. The second pump may therefore be an oil-sealed rotary valve pump of a general type which is well known in the vacuum industry or, preferably, is a 'dry' pump again of the type well known in the vacuum industry and employing, for example, rotors of a 'Roots' or 'Claw' profile (or mixtures thereof, for example four or five stages, in a single pump body.

As with the first pump, more than one second pump may be employed.

Ballast gas flows are commonly employed in the operation of turbo-molecular pumps but additional amounts of ballast gas, for example nitrogen, may be added directly in to the pump or in to the second line for recirculating via the third line as appropriate or necessary.

The chamber to which the vacuum system is attached should process means to allow the introduction of process gases from external sources of gases, means to perform the semiconductor processes therein, for example the etching of metallic layers or the deposition of species on to silicon materials, and means to measure the pressure in the chamber.

The vacuum system should possess, in addition to the vacuum pumps and valve described above, a control means to regulate the chamber pressure by adjusting the flow resistance through the variable valve means. Such a control means may be part of a larger control means for the operation of the processing chamber, associated equipment and the vacuum pumping system as a whole.

BRIEF DESCRIPTION OF THE DRAWING

For a better understanding of the invention, reference will now be made, by way of exemplification only, to the accompanying drawings in hand.

DETAILED DESCRIPTION

Figure 1:
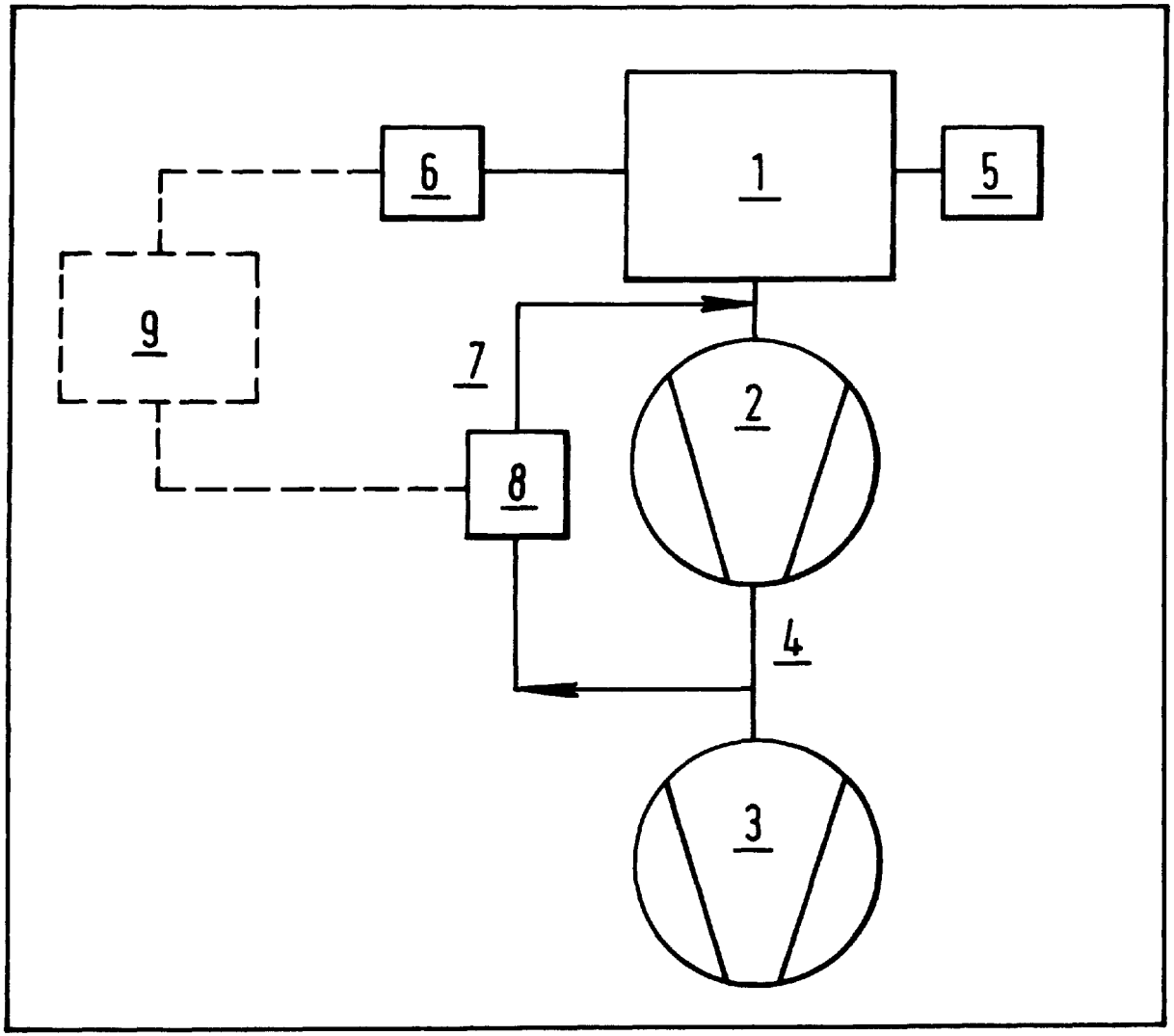
FIG. 1 is a schematic representation of a vacuum pumping system of the inventor.

With reference to FIG. 1, a vacuum pumping system for use with a processing Chamber 1 comprises a first vacuum pump 2 whose inlet is linked to the chamber 1 via a first line and a second vacuum pump 3 linked by a second line in the form of a foreline 4.

Means 5 are provided for the introduction of process gases in to the chamber 1 and pressure sensing means 6 are also provided for the measurement of pressure inside the chamber 1.

In accordance with the invention, a third line 7 extends between the first line linking the chamber 1 and the first vacuum pump 2 and the second line (foreline 4) linking the first vacuum pump 2 and the second vacuum pump 3. A throttle valve 8 is present in the third line 7. The throttle valve 8 may be of any suitable type and is preferably servo-operated, for example a butterfly valve or a poppet valve.

Finally, a control means 9 is present for the purpose of regulating the pressure in the chamber primarily by adjusting the opening of the throttle valve 8 by signals received from the pressure sensing means 6 to which it is linked.

The first vacuum pump 2 is preferably a turbo-molecular pump which may advantageously also possess a molecular drug stage, for example a Holweck stage. Such a pump, also incorporating the variable orifice valve is described in more detail with reference to FIG. 2 below.

The second vacuum pump 3 is preferably a dry operating vacuum pump employing any known mechanism but preferably containing 'Roots' profile rotors or 'Claw' rotors or mixtures thereof all of which are well known in the vacuum industry. A pump having a 'Roots' profile rotor fair in a stage at the pump inlet and three 'Claw' profile rotor pairs at the pump outlet is particularly preferred.

The throttle valve 8 can generally be any suitable valve for which different flow resistances (including zero) can be set by varying the orifice or opening in the valve.

A butterfly valve is especially preferred.

In operation of the vacuum pumping system shown in FIG. 1, the first and second vacuum pumps 2, 3 are operated in series to evacuate the chamber 1 to a predetermined general level of vacuum. Semiconductor processing is effected in the chamber 1 using process gases fed in to the chamber 1 by the gas delivery means 5 and the process operating pressure monitored by the pressure meaning means 6.

Depending on the pressure in the chamber and any required variations thereto in the light of the process/reactive gas species or by-product species present in the chamber, the control means 9 operated to cause the throttle valve 8 to be positioned to cause a flow resistance in the third line 7 and thereby exercise control in the pressure at the outlet of the chamber 1.

The flow resistance in the line 7 allows a variation (including zero) in the amount of gas exhausted from the chamber via the pump 2 to be recirculated via the third line 7 back to the inlet of the pump 2.

The supplementary use of ballast gas, for example nitrogen, in to the pump or in to the foreline 4 may assist in this process by causing a greater gas flow overall through the third line 7.

Figure 2:
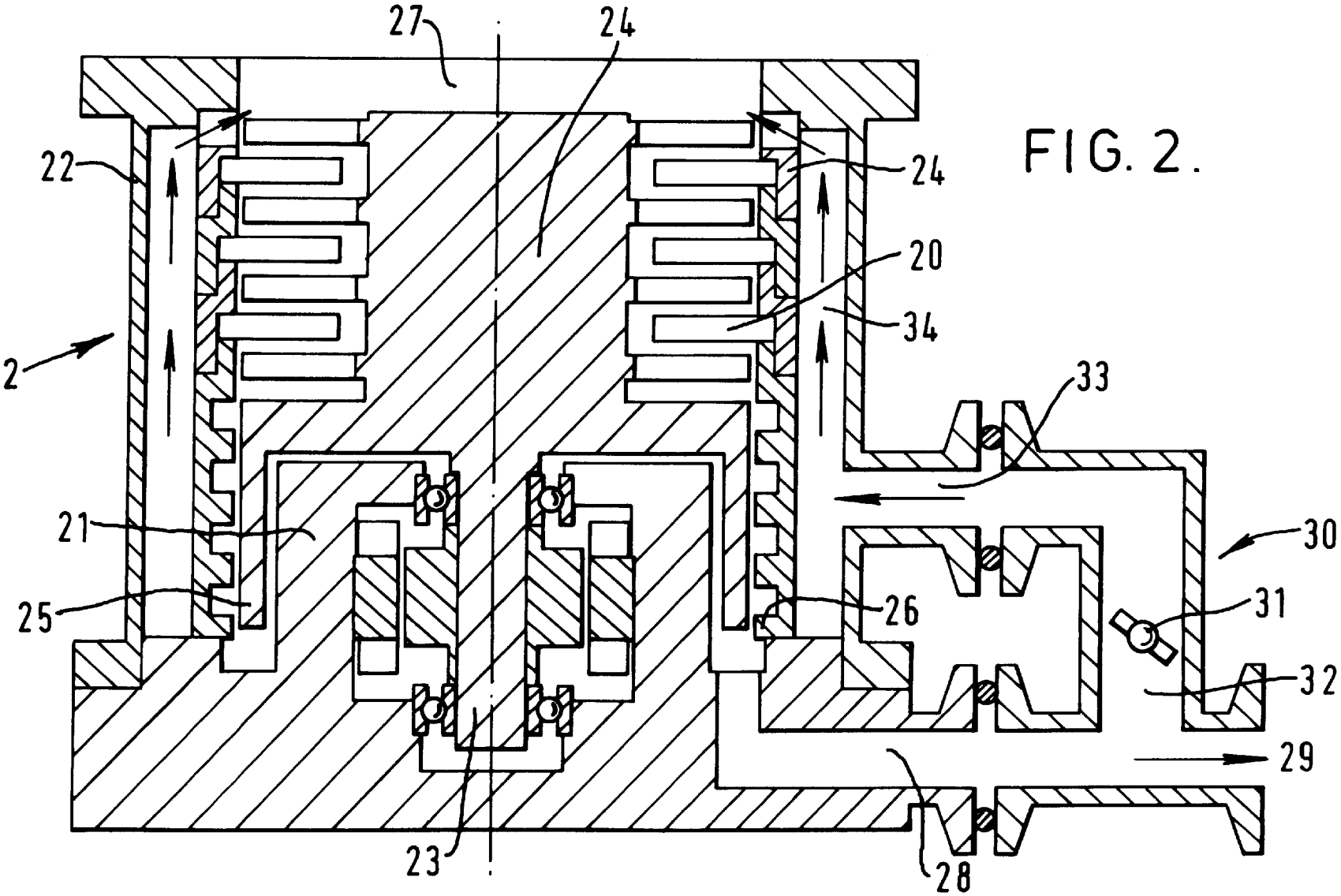
FIG. 2 is a representation of a vacuum pump for use in the system of FIG. 1 incorporating a valve means.

Turning to FIG. 2, there is shown a particular design for the vacuum pump 2 of FIG. 1 incorporating a throttle valve.

The pump 2 comprises a turbo-molecular stage 20 and a subsequent molecular drag (Holweck) stage 21.

Both stages are contained in the same pump body 22 and the rotor for each stage are attached to a simple shaft 23. The rotor 24*e* of the turbo-molecular stage possesses the normal arrays of angled blades which, in use of the pump, are rotated at high speed between similar stationary arrays of angled blades on the starter 24*b*. These stationary arrays are supported by spacing rings.

The rotor 25 of the Holweck stage is the normal cylindrical shape and rotates at the same high speed within a stator comprising a helical groove arrangement 26.

In operation of the pump 2, gas flow through an inlet 27 through the turbo-molecular stage, then through the Holweck stage and exits via an outlet 28 in the direction of the foreline 29.

Connected to the pump 2 is a throttle valve generally indicated at 30 and comprising primarily a valve member 31 operated by means not shown to close or variably open the third line of the system shown in FIG. 1 which in FIG. 2 is shown by the reference numerals 32, 33, 34. The third line comprises an annular gap formed between the outer casing of the pump and the spacing rings, and grooves or holes formed in the spacing rings.

The line 32, 33, 34 links the foreline 29 with the inlet 27 to the vacuum pump 2 in accordance with the requirements of the inventor.

Depending on the degree of opening of the valve member 31, and hence the degree of flow resistance offered by the throttle valve, gas exhausted through the valve 31 will be drawn through the line 32, 33, 34 by gas pressure differential as required by the process conditions in the processing chambers.

I claim:

1. A vacuum system for use with a process chamber having a chamber outlet, said vacuum pumping system comprising:

first and second vacuum pumps, each having an inlet and an outlet;

first, second and third lines;

the first line in direct fluid flow communication between said inlet of the first vacuum pump and said chamber outlet, the second line communicating between said inlet of the second vacuum pump and said outlet of the first vacuum pump; and the third line linked to the first and to the second lines in parallel to the first vacuum pump; and means to regulate the flow of gases in the system consisting of a single throttle valve situated in the third line such that, when it is at least partially open, gas will flow from the second line back to the first line by means of the pressure differential across said first pump.

2. The pumping system according to claim 1 in which the first pump comprises a turbo-molecular pump having a stator and a rotor with both having a number of arrays of angled blades to effect a pumping action.

3. The pumping system according to claim 1 in which the first pump comprises a turbo-molecular pump and one or more molecular drag or regenerative stages contained in the same pump body.

4. The pumping system according to claim 1 wherein said first pump is comprised of more than one stage and the third line links the first line at the inlet to the first pump and a stage of the first pump.

5. The pumping system according to claim 1 including a central means to regulate the chamber pressure by adjusting the flow resistance through the throttle valve.

6. The pumping system according to claim 1 in which the throttle valve is a butterfly valve.

7. The pumping system according to claim 1 in which the throttle valve is a poppet valve.

* * * * *